US006472007B2

(12) United States Patent
Bezek et al.

(10) Patent No.: US 6,472,007 B2
(45) Date of Patent: Oct. 29, 2002

(54) CONSUMABLES CONTAINER WITH MULTI-FUNCTIONAL CAP

(75) Inventors: Edward Anthony Bezek, Frisco, TX (US); Patrick Joseph Bierschenk, Dallas, TX (US); John Joseph Michels, Highland Village, TX (US)

(73) Assignee: Recot, Inc., Pleasanton, CA (US)

( * ) Notice: Subject to any disclaimer, the term of this patent is extended or adjusted under 35 U.S.C. 154(b) by 0 days.

(21) Appl. No.: 09/906,458

(22) Filed: Jul. 16, 2001

(65) Prior Publication Data

US 2002/0008106 A1 Jan. 24, 2002

Related U.S. Application Data

(63) Continuation-in-part of application No. 09/538,540, filed on Mar. 30, 2000.

(51) Int. Cl.[7] ..... B65D 51/20

(52) U.S. Cl. ..... 426/115; 426/106; 426/131; 206/497; 206/505; 206/515; 215/7 D; 215/228; 215/232; 215/384; 215/387; 220/212

(58) Field of Search ..... 215/7 D, 382, 215/383, 384, 387, 232, 228; 206/215, 217, 477, 505, 515, 543; 220/212; 228/392, 393; 426/106, 115, 131

(56) References Cited

U.S. PATENT DOCUMENTS

| | | | |
|---|---|---|---|
| 2,076,132 | A | 4/1937 | Le Rose |
| 2,121,041 | A | 6/1938 | Morgan |
| 2,297,285 | A | 9/1942 | Bledsoe |
| 2,346,417 | A | 4/1944 | Cornwell et al. |
| 2,533,349 | A | 12/1950 | Burger |
| 2,543,427 | A | 2/1951 | Warne |
| 2,619,245 | A | 11/1952 | Levi |
| 2,766,796 | A | 10/1956 | Tupper |
| 3,021,977 | A | 2/1962 | Hester |
| 3,760,968 | A | 9/1973 | Amberg et al. |
| 3,813,000 | A | 5/1974 | Underwood |
| 3,828,999 | A | 8/1974 | Humphrey |
| 3,915,296 | A | 10/1975 | Spencer |
| 3,952,911 | A | 4/1976 | Bozek et al. |
| 4,051,265 | A | 9/1977 | Kirschenbaum et al. |
| 4,054,220 | A | 10/1977 | Rosenstein |
| D246,896 | S | 1/1978 | Plummer |
| D247,471 | S | 3/1978 | Strand |
| D247,472 | S | 3/1978 | Byrne |
| 4,077,538 | A | 3/1978 | Waterbury |
| D247,847 | S | 5/1978 | Kretz |
| 4,163,517 | A | 8/1979 | Kappler |

(List continued on next page.)

FOREIGN PATENT DOCUMENTS

| | | |
|---|---|---|
| FR | 2646071 | 4/1989 |
| WO | WO 92/04243 | 3/1992 |

OTHER PUBLICATIONS

Advertisement by Land O'Lakes showing a personal size container for beverages, trademarked as the "Grip." It also has a resealable top.

*Primary Examiner*—K. Hendricks
*Assistant Examiner*—Hao Mai
(74) *Attorney, Agent, or Firm*—Colin P. Cahoon; Carstens, Yee & Cahoon

(57) ABSTRACT

An improved container for food and other perishable products comprising a simple construction and a multi-functional cap. The container allows for the storage of multiple products separately within the container as well as consumption of the products while "on the go." The multi-functional cap nests over and seals the mouth end of the container, allows for the nesting of a sub-container inside the cap, and allows the products to be resealed without contaminating each other. The container is ergonomically and stylishly shaped to provide a comfortable hand grip for a variety of consumers.

35 Claims, 8 Drawing Sheets

U.S. PATENT DOCUMENTS

| | | | | |
|---|---|---|---|---|
| 4,190,168 | A | | 2/1980 | Jacques |
| D254,840 | S | | 4/1980 | Aldrich, III |
| RE30,805 | E | | 11/1981 | Rhoads |
| 4,417,504 | A | | 11/1983 | Yamamoto |
| 4,444,324 | A | | 4/1984 | Grenell |
| 4,483,890 | A | | 11/1984 | Beery et al. |
| 4,819,819 | A | * | 4/1989 | Robertson, Jr. ..... 215/230 |
| 5,065,923 | A | | 11/1991 | Hoefer et al. |
| D345,695 | S | | 4/1994 | Frazer et al. |
| 5,383,558 | A | | 1/1995 | Wilkinson et al. |
| 5,429,262 | A | | 7/1995 | Sharkey |
| 5,482,170 | A | | 1/1996 | Semersky et al. |
| 5,499,763 | A | | 3/1996 | DeMars |
| D371,304 | S | | 7/1996 | Onneweer |
| 5,613,620 | A | | 3/1997 | Center et al. |
| 5,788,076 | A | | 8/1998 | Simmons |
| 5,797,509 | A | | 8/1998 | Fitch |
| 5,938,062 | A | | 8/1999 | Paramski |
| 6,006,945 | A | | 12/1999 | Kirkland |
| D418,758 | S | | 1/2000 | Yucknut |
| 6,152,302 | A | | 11/2000 | Miller et al. |
| 6,170,666 | B1 | | 1/2001 | DesLauriers |

* cited by examiner

CONSUMABLES CONTAINER WITH MULTI-FUNCTIONAL CAP

This application is Continuation-In-Part of 09/538,540 field on Mar. 30, 2000.

BACKGROUND OF THE INVENTION

1. Technical Field

The present invention relates to a rigid container or canister suitable for storing food products (consumables) with a multi-functional cap. In one embodiment, the cap nests over the mouth end of the container when the container is sealed, but can also nest with the base end of the container for storage while the container is in use. A sub-container can be placed within the cap and later inverted, inserted into the mouth end of the container and re-sealed by the cap. Further, when inverted, the cap seats into the open end, thereby acting as a bowl. The container consists of a molded body that can be wrapped with a thin film graphics carrier. In one embodiment of the invention, the thin film graphics carrier contributes to the barrier properties of the container. The container stands unsupported for a shelf display or can be vendable from soft drink vending machines.

2. Description of Related Art

The design and construction of packaging for containers of consumables, such as potato chips, tortilla chips, chip and dip kits, or other snack products, requires the consideration of several sometimes competing factors. One factor to consider is that the container must be designed to protect the product contained therein from degradation, microbial spoilage, and physical damage. Ideally, the container should possess barrier properties that limit or prohibit the migration of oxygen, moisture, and light through the container when sealed. Oxygen and moisture migration into a container reduces the product's shelf life. Product degradation can also be slowed if the barrier properties of the container limit the exposure of the product to light. Breakage of the product can be limited by either placing the product in a rigid container or providing sufficient slack-fill in a non-rigid container to provide an air cushion within the container.

Another factor to consider regarding consumables container design is the marketing aspect, or presentation, of the container. A consumables container should provide an appealing presentation of the product contained therein. It is often desirable that the container be capable of standing unsupported on a store shelf. Further, the container must be capable of supporting graphics either affixed to the container or embedded in the container to assist with brand recognition and the appearance of the packaging. Many prior art containers are constructed of at least three layers, and typically more, consisting of a moisture barrier, an oxygen barrier, a light barrier, and a graphics carrier, all of which are molded or shaped for a desired presentation.

The specific barrier properties of a container are frequently dependent on the product that must be protected. For example, some products, such as crackers, do not need an oxygen barrier for protection. Likewise, other products may not need a moisture barrier or a visible light barrier. Consequently, containers are usually designed with the minimal barrier properties required to protect the specific products to be contained therein.

Another factor in consumables container design is the economics and efficiencies of filling and shipping the container. Containers are ideally constructed to easily and efficiently fill with product on a production line. Further, the containers must fit economically into boxes or crates in order to minimize shipping costs. It might also be beneficial for individual components of a container, such as a container cap, to be easily stacked for shipment and handling prior to installation on the container.

Another design criteria for consumables container design is the cost and ease of construction of the container. Every layer added to the container may provide additional desired barrier properties. However, the addition of every layer also drives up the cost of constructing the container. Generally speaking, less expensive containers limit the layers of material and the amount of material involved in the construction of the container.

A design of a specific consumables container may also have many application specific design criteria. For example, marketing considerations may make it desirable to construct the container so that it is particularly useful in dispensing or holding a product while being consumed by the consumer. The container may be designed with an easy-open top, a dimension or shape that makes it easy to hold the container in one hand, and an opening sufficient in size for the consumer to retrieve the product from the container by pulling out the product by hand. Another example of an application specific consideration involves dispensing consumables containers from what are traditionally soft drink vending machines. Such containers, referred to as "vendable" containers, must be designed of an appropriate dimension and weight to be easily loaded and dispensed from standard soft drink vending machines. Such dimensions can also make a container suitable for use with a cup holder in an automobile.

Likewise, the ergonomics of the container must be considered. The container can be designed to be easily grasped and held in one hand. Some containers are designed to allow for direct consumption of the product by pouring the product out of the container into the consumer's mouth.

The utility of various components of the container is also an important design consideration. The cap that seals the container might also be used as a bowl or cup to hold the product for consumption by the consumer. The container itself may provide for other functional uses or provide for special re-seal capabilities.

The above items are not all-inclusive, but representative of design considerations regarding consumables containers. Frequently, these and other design considerations are in conflict and require balance and compromise. For example, a certain marketing look or presentation may be impractical because it reduces packaging efficiencies or gives rise to difficulties in production line filling or construction. Heavy and multi-layered construction provides ideal barrier properties for protecting a product, but can greatly increase the cost and complexity of construction. The addition of consumer oriented features, such as easy open and resealable tops, can also introduce complexities in manufacturing and increase overall cost. As a result, the snack food industry has yet to develop a container that is of simple and inexpensive construction, provides a unique shelf presentation, provides various consumer friendly features that allow for single-handed operation, provides for storage or multiple products, and provides for sufficient barrier properties in an economical and efficient design.

In particular, there does not exist in the prior art a vendable consumables container with a cap that performs several functions in an efficient, simple, and economical design. Most containers with removable caps do not provide for any function for the removable cap other than for use to reseal the container. Further, there is typically no provision on the container for stowage of the removable cap while the container is in use. Frequently, a second cup or bowl must be used, independent from the container, when the consumer wants to pour out only a portion of the food product in the container. While some prior art containers combine two of the features listed above, none of them incorporate a cap design that acts as a cup that can be placed on top of the container, can be stored on the bottom of the container when not in use, and used to seal the container for storage of the food product, along with a container design that lends itself to single-handed use by the consumer in a vendable and shelf presentable package. Further, none of the prior art containers incorporate a cap design that acts as a separate compartment for a second product to complement the primary product such as dip for potato chips. Prior art "chip and dip" combination containers are very expensive, difficult to use, bulky, and unattractive. For example, one prior art design comprises a bulky thermoformed tray that is used to contain a bag of chips and a dip container. The tray is sealed with a large film to hold the contents in place. The end user removes the film, opens and pours the bag of chips into the tray and then eats from this large package. Because of its bulk, the package is not very portable, and the costs of manufacturing are high.

Accordingly, a need exists for an easily manufactured consumables container that incorporates a multi-functional cap with an economical design. The container should provide acceptable and appropriate barrier properties, as well as physical containment and protection of the product. The multi-functional cap should act as a sealing means on the mouth end of the container, should store on the bottom of the container when not in use, and should act as a cup or bowl that can be seated on the top of the container for single-hand use by the consumer. The multi-functional cap should also be adaptable for storing a second product such as dip separate from the main product. The multi-functional cap should allow for effective and efficient resealing of the unused portion of the product(s). The container should be capable of standing unassisted on store shelves or, alternatively, being dispensed from a soft drink vending machine. Such a design should be simple and inexpensive to manufacture, provide for packaging and filling efficiencies, and be intuitively functional to the consumer.

SUMMARY OF THE INVENTION

The proposed invention comprises an economically designed, vendable container for snacks and other perishable foods with a multi-functional cap. One embodiment comprises a generally cylindrical container with a multi-functional cap nested over the mouth end of the container and an outer film wrapped over the cap and container after the container is filled. The outer film can also complement the barrier properties of the container.

The invention is simple and inexpensive to manufacture, provides adequate protection for the product contained therein, and is easy to use for the consumer. The multi-functional cap reseals the container, can be used as a bowl for product and as a compartment for a second product such as a condiment. The container is capable of standing unassisted on a store shelf or being dispensed from a soft drink vending machine. The container is an improvement over the prior art in ease of manufacture, packaging efficiencies, and functional use by the consumer.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1A:
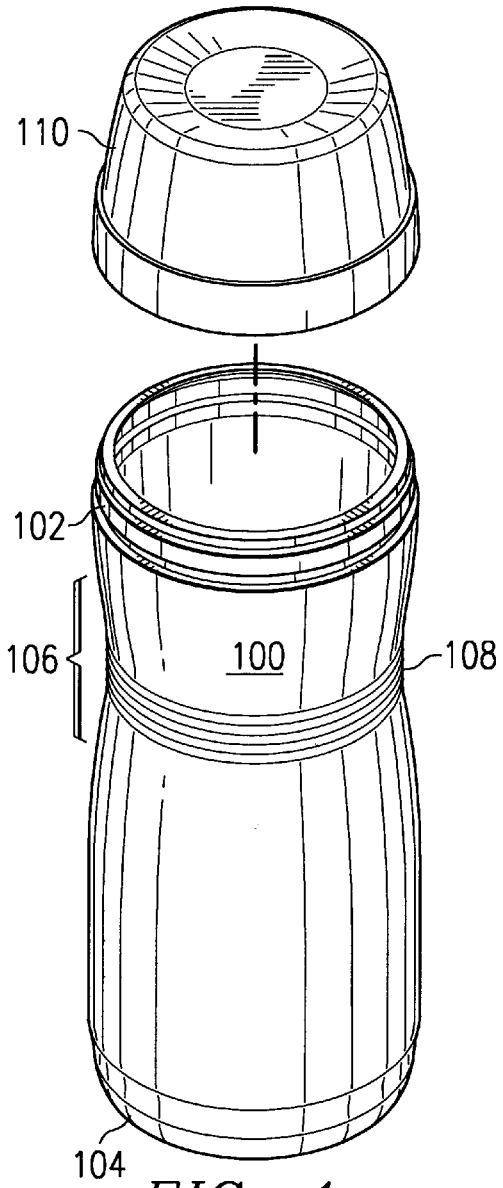
FIGS. 1*a* and 1*b* are perspective views showing a cylindrical embodiment of the invention.
Figure 1B:
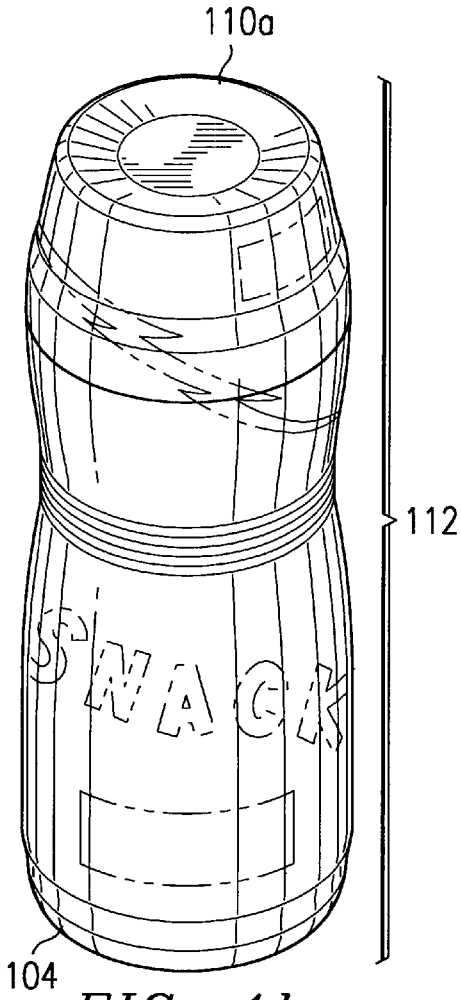

FIGS. 1*a* and 1*b* show perspective views of a cylindrical embodiment of the present invention. Referring to FIG. 1*a*, the container comprises a receptacle 100 which provides for the rigidity of the container as well as necessary oxygen and moisture barrier properties. The receptacle 100 can also be opaque in order to preclude exposure to light on the product contained therein. The receptacle 100 is typically blow molded and can be constructed of high density polyethylene, which provides for effective moisture barrier properties, or ethethylene vinyl alcohol, which provides for effective oxygen barrier properties. Examples of other suitable material for use in constructing the receptacle include polyethylene and polyester. In an alternative embodiment, the receptacle 100 can be multi-layers or constructed of a material that provides for both effective oxygen and moisture barrier properties.

The receptacle 100 comprises a mouth end 102, a base end 104, and a slightly circumferentially constricted central section 106. The constricted central section 106, in one embodiment, comprises corrugation 108 about the circumference of the container. This corrugation 108 provides additional circumferential strength and, in combination with the tapering to slight constriction of the central section 106, a convenient hand grip for the consumer.

The mouth end 102 of the receptacle 100 is tapered to nest with a cap 110. The mouth end 102 is also dimensioned such as to allow the cap 110 to be inverted and act as a cup when placed or seated into the mouth end 102, as will be described in further detail in conjunction with FIG. 3. The cap 110 is also dimensioned to nest over the container base 104, as will be further described in connection with FIG. 4.

The first step in manufacturing the container of Applicants' invention involves constructing the receptacle 100. This is typically done by blow-molding of the material selected, but could also be accomplished by injection molding, thermal forming, or other means used in container manufacturing. After the receptacle 100 is removed from the mold, it can be filled with product or consumables, such as corn-based snack foods, dropped into the receptacle 100 through the mouth end 102. After the receptacle 100 is filled with product, a removable seal (shown as reference 220 in FIG. 2*a*) is secured over the mouth end 102 of the container by methods well known in the industry. This removable seal can be, for example, a metalized polyester secured by a heat and pressure seal or other means. Once the removable seal is placed over the mouth end 102, the cap 110 is then nested over the mouth 102.

Referring to FIG. 1*b*, an outer layer 102 is then wrapped over the cap 110 and a portion of the receptacle 100. In the alternative embodiment that requires more barrier properties than provided by the receptacle 100, the selection of whether the outer layer 112 is a material that also provides additional oxygen barrier, moisture barrier, or light barrier properties depends on the selection of the material used for the receptacle 100. If the receptacle 100 material provides an oxygen barrier, the outer layer 112 material selected could provide moisture barrier properties, and vice versa. The outer layer 112 can also act as a graphics carrier. Alternatively, the container can be constructed without an outer layer 112 by embedding graphics within the receptacle 100 or screen printing graphics directly on the receptacle 100.

The outer layer 112 can comprise a shrink-wrap and made of, for example, polyethylene terephtalate to provide additional oxygen barrier properties or polypropylene to provide additional moisture barrier properties. Both materials can also act as acceptable graphics carriers. One embodiment of the container uses a polyvinyl chloride shrink wrap 112, which adds additional light barrier properties when used as a graphics carrier and some additional moisture barrier properties.

The list of acceptable materials for use in either the receptacle 100 or the outer layer 112 is not exhaustive. Rather, any material available in the field of art that provides the adequate barrier properties along with desirable molding, rigidity, and graphics characteristics can be used in combination. This is true for all embodiments of the invention.

To further reduce manufacturing costs and complexity, the embodiment shown in FIG. 1*b* illustrates that the outer layer 112 is wrapped such that it covers all but the top end 110*a* of the cap 110 and the bottom or base 104 of the container. By not wrapping the top of the cap 110*a* and the bottom 104 of the container, the application of the outer layer shrink-wrap 112 is simplified and requires less material per container. The potential loss of barrier property provided by the outer layer in this design is minimal because the bottom 104 of the container will typically rest on a hard surface and, at least until opened, the container mouth 102 further incorporates a removable seal which can provide substantial barrier properties of its own. Alternatively, the outer layer 112 could be wrapped only over the receptacle 100, thereby further saving manufacturing costs.

In a vendable embodiment of the present invention, the height of the receptacle 100 from the mouth end 102 to the bottom 104 is approximately 6.63 inches. The diameter of the receptacle 100 at its maximum dimensions above and below the center section 106 is approximately 2.75 inches. The maximum circumference of the container above and below the center section 106 should be identical, in order to provide support between adjacent containers when proceeding down a processing line, when stacked on store shelves, or packed for shipping, by allowing contact between the containers both below and above the center of gravity of each. This contact at the bottom and top of adjacent containers helps with the stability of the containers when placed in contact. The minimum circumference of the center section 106, in this vendable embodiment, is approximately 2.4 inches. The total height of the container with the cap 110 nested on the mouth end 102 in this embodiment is 7.84 inches. Such dimensions are suitable for vending the container from a standard 20-oz. soft drink vending machine.

As shown in FIG. 1*a*, the mouth end 102 is slightly tapered both to properly nest in the cap 110 and to provide a pouring function from the mouth end 102 into the cap 110 or other receptacle. Further, the tapered shape helps prevent unintended spillage of the product out of the mouth end 102.

Figure 2A:
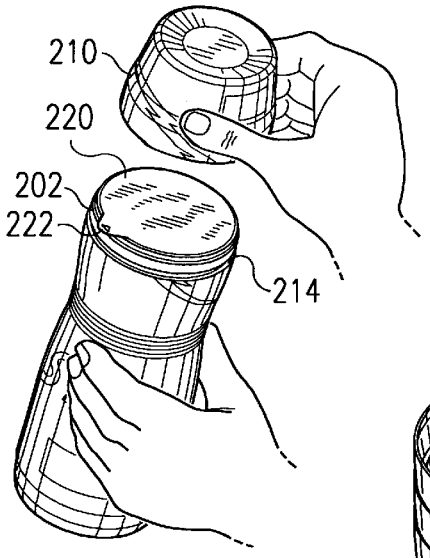
FIGS. 2*a* and 2*b* are perspective views illustrating the removal and filling of the multifunctional cap in one embodiment of the invention.
Figure 2B:
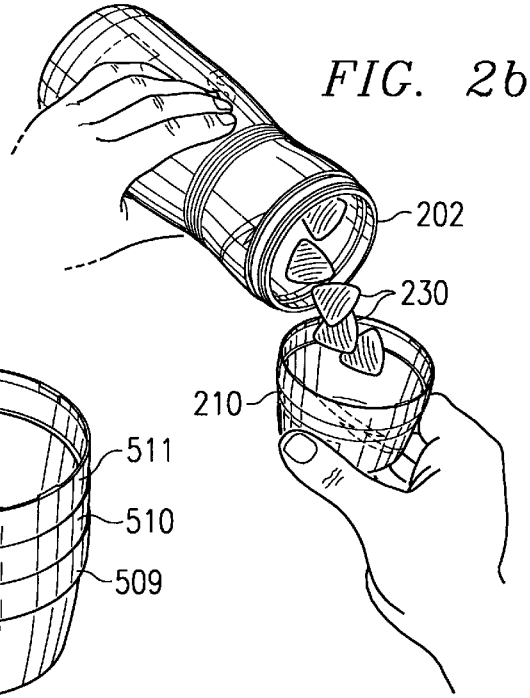

FIGS. 2*a* and 2*b* show the container in use by a consumer. First, the consumer removes the cap 210 by twisting the cap 210 and breaking the outer layer at the intersection of the cap 210 and a rim 214 below the mouth end 202. The removal of the cap 210 reveals the seal 220 affixed to the mouth end 202. The seal 220 is removed by pulling on an exposed tab 222.

Once the seal 220 is removed, the contents of the container, such as a puff-corn snack 230, can be poured into the cap 210. The product 230 can also be poured directly into the consumer's mouth. To reseal the container, the cap 210 is again nested over the mouth end 202.

Figure 3:
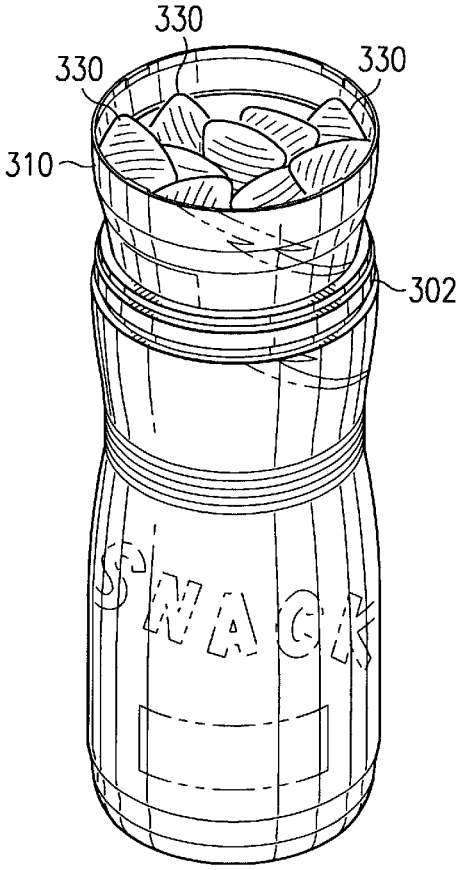
FIG. 3 is a perspective view of a cylindrical embodiment of the invention with the cap inverted and seated in the open end of the container.

The container is designed to provide a convenient one-hand use, as illustrated in FIG. 3. Once filled, the inverted cap 310 can then be seated in the mouth end 302 of the container, thus both holding product 330 for consumption and sealing the container. Since the vendable design of the container closely approximates a 20-oz. bottle of soft drink, the container can be held in one hand while the consumer removes product 330 from the inverted cup 310 with the other hand. The container can also be placed in a typical cup holder inside a vehicle while the consumer is consuming the product 330 from the inverted cap 310.

Figure 4:
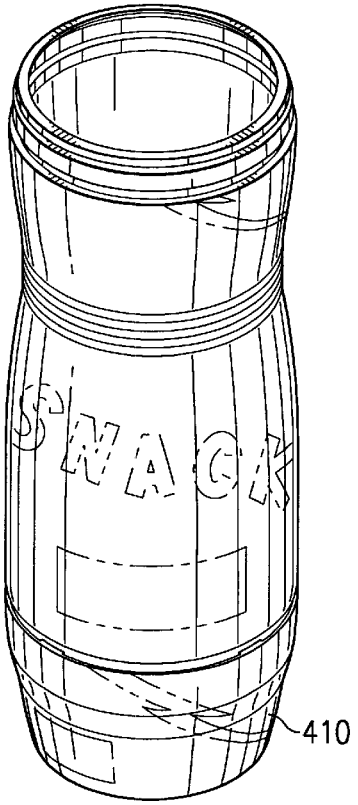
FIG. 4 is a perspective view of a cylindrical embodiment of the invention with the cap nested on the bottom of the container.

Another function of the cap allows for it to be stored at the bottom of the container. This is illustrated in FIG. 4, which shows the cap 410 nested over the base of the container. In this configuration, the consumer can pour product directly into the consumer's mouth, hand, or other container without worrying about holding the cap 410 or placing it in a location for later retrieval and resealing of the container.

Figure 5:
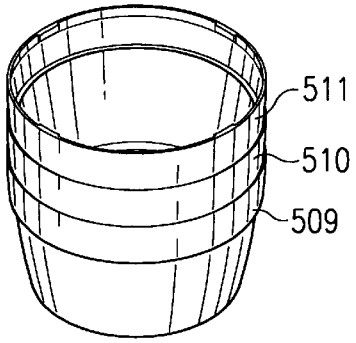
FIG. 5 is a perspective view of caps of one of the embodiments of the invention stacked together.

FIG. 5 illustrates another feature of one embodiment of the invention. Specifically, three caps 509, 510, 511 are shown stacked together to illustrate the packing efficiencies accorded by the cap design. Specifically, a collar around the open end of the cap (which is the only portion of the middle cap 510 exposed) provides for easy stacking and unstacking of the caps after manufacture and prior to installation on the receptacle. This collar promotes automatic stacking of the cups without sticking together and increases the hoop strength of each individual cap. Further, it is understood that the cap can be manufactured of material and in a manner similar to that discussed with regard to the manufacture of the receptacle portion of the invention.

The embodiment illustrated involves a generally cylindrical shape. However, it should be understood that the invention could also comprise any number of shapes. For example, a triangular geometry could be used for the receptacle in order to accommodate stackable tortilla chips. A square or rectangular geometry could be used to accommodate square crackers or other similar products. Likewise, it may be desirable to construct an oval geometry for the receptacle, as opposed to circular geometry, to more closely approximate to the shape of form-fried and stacked potato chips. The geometry of the cap can be adjusted to match the geometry with the receptacle in order to provide the nesting, sealing, and seating functionality previously described. Further, the container could comprise other designs for the cap and mouth end of the container, including a gabled carton type opening. Examples of other alternative embodiments of the present invention, illustrating primarily various container and cap designs that can be incorporated in any number of combinations, are shown in FIGS. 6*a*, 6*b*, 6*e*, 6*d*, 7*a*, 7*b*, 7*c*, 8*a*, 8*b*, 8*c*, 9*a*, 9*b*, 9*c*, 10*a*, 10*b*, and 10*c*.

Figure 6A:
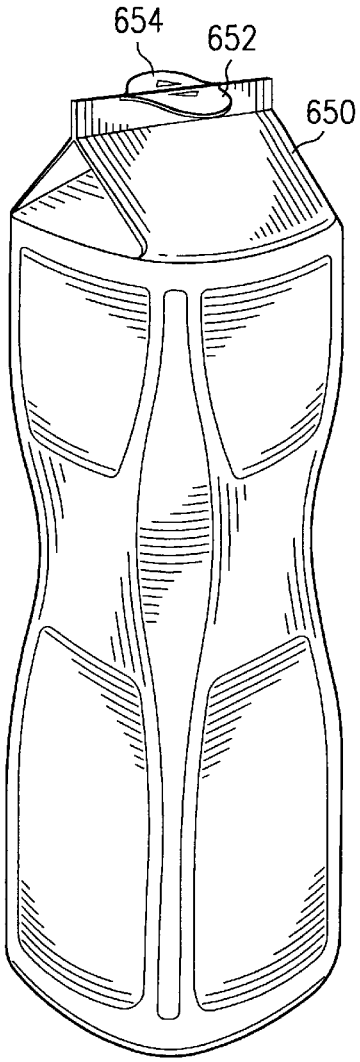
FIGS. 6*a*, 6*b*, 6*c*, and 6*d* are perspective and partial views of a gabled carton embodiment of the present invention.
Figure 6B:
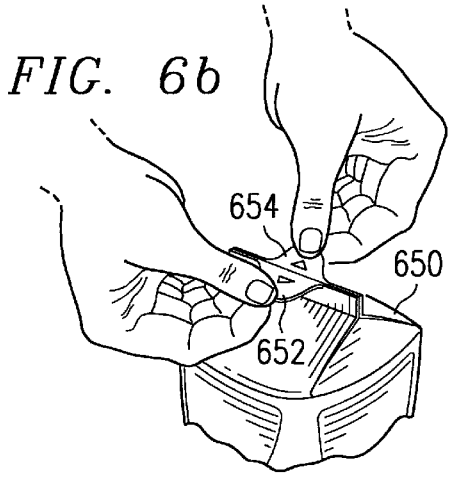
Figure 6C:
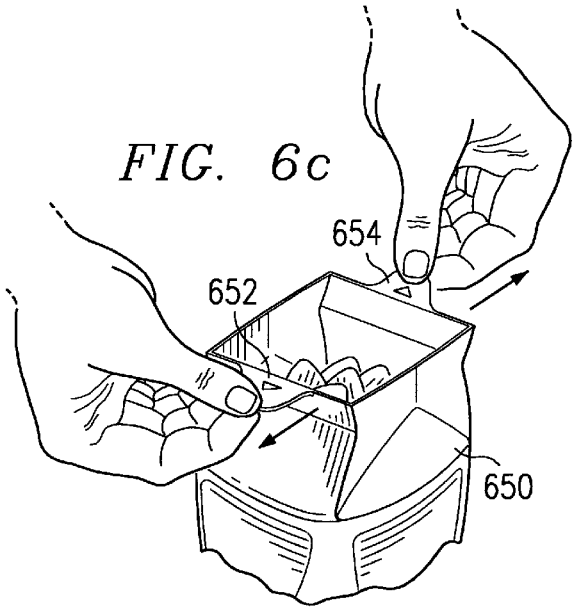
Figure 6D:
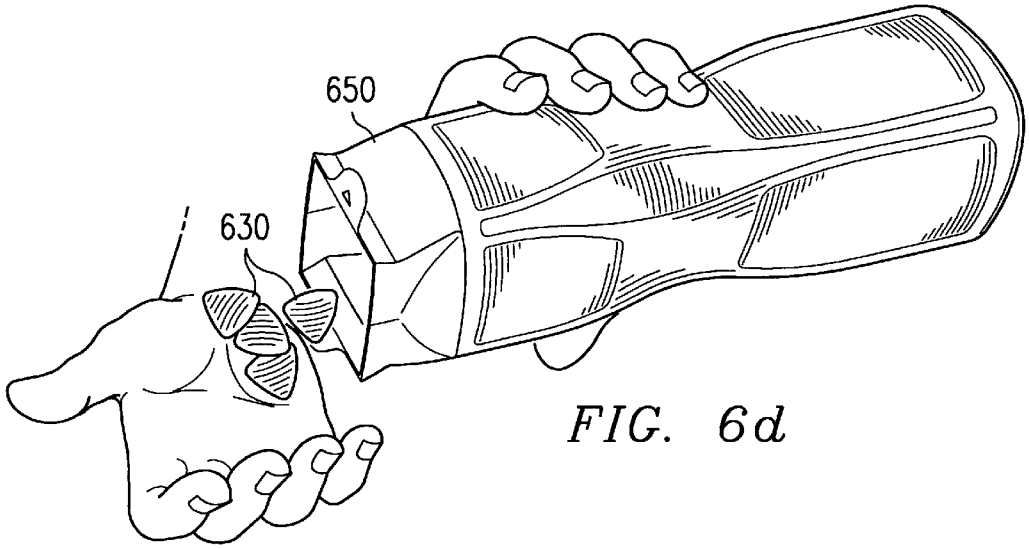

A gabled carton shaped embodiment is shown in FIGS. 6*a*, 6*b*, 6*c*, and 6*d*. This container can again be comprised of a receptacle and outer graphics layer as described previously with regard to the alternative cylindrical embodiments. Likewise, the shape of the container itself can be primarily square, as illustrated, cylindrical, triangular, or any other number of shapes to accommodate various product or promote various marketing considerations. A variation illustrated in this embodiment, however, is the gabled carton top 650. This top is opened by pulling apart two tabbed sealing members 652, 654. This opening action of pulling on the two sealing members 652, 654 is illustrated in FIGS. 6*b* and 6*c*. Once the gabled carton top 650 is opened, the product 630 can be poured out for consumption, as illustrated in FIG. 6*d*.

Figure 7A:
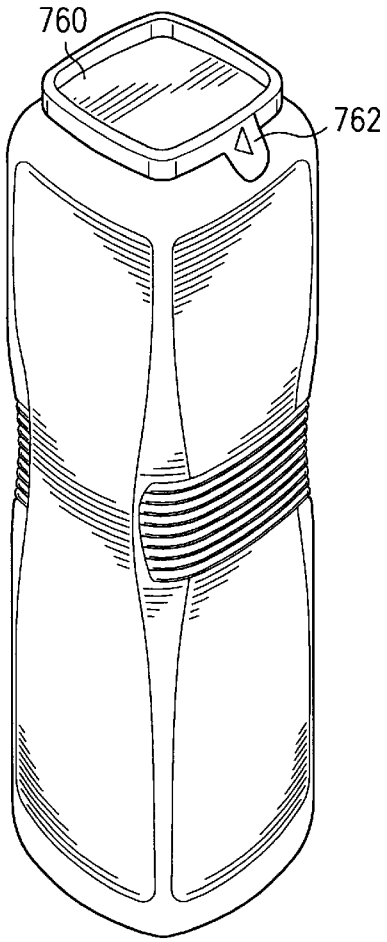
FIGS. 7*a*, 7*b*, and 7*c* are perspective and partial views of a tear-away cap and square shaped container embodiment of the present invention.
Figure 7B:
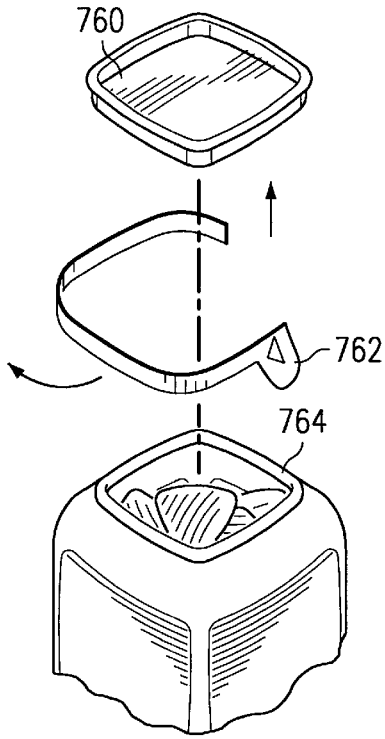
Figure 7C:
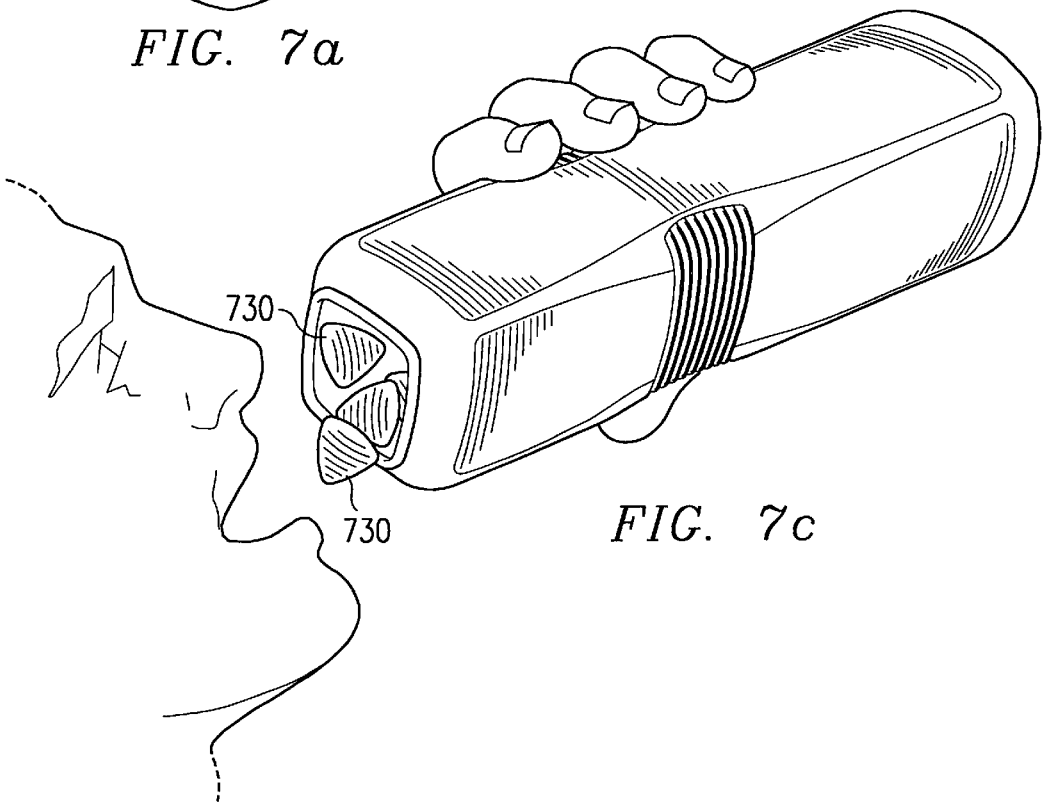

FIGS. 7*a*, 7*b*, and 7*c* show another variation on a square shaped container with a tear-away tab 762 which seals a cap 760 to the top of the container. To access the product, the consumer tears away a removable pull tab and seal portion 762 and removes the cap 760, as is illustrated in FIG. 7*b*. Removal of the cap 760 then makes the product 730 available to the consumer as is illustrated in FIG. 7*c*. The cap 760 in this embodiment can be snapped back onto the container, nesting in a ridge 764 defining the opening of the container.

Figure 8A:
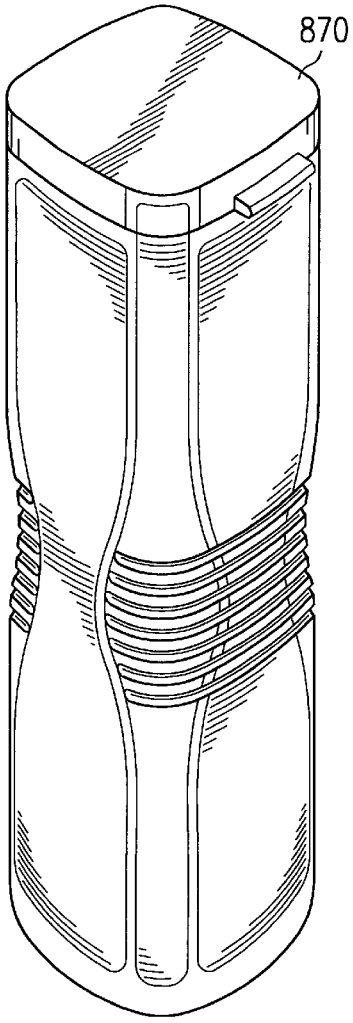
FIGS. 8*a*, 8*b*, and 8*c* are perspective and partial views of a pop-top cap and square container embodiment of the present invention.
Figure 8B:
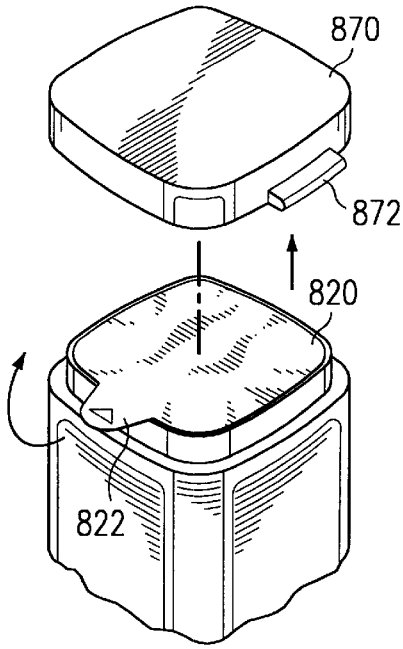
Figure 8C:
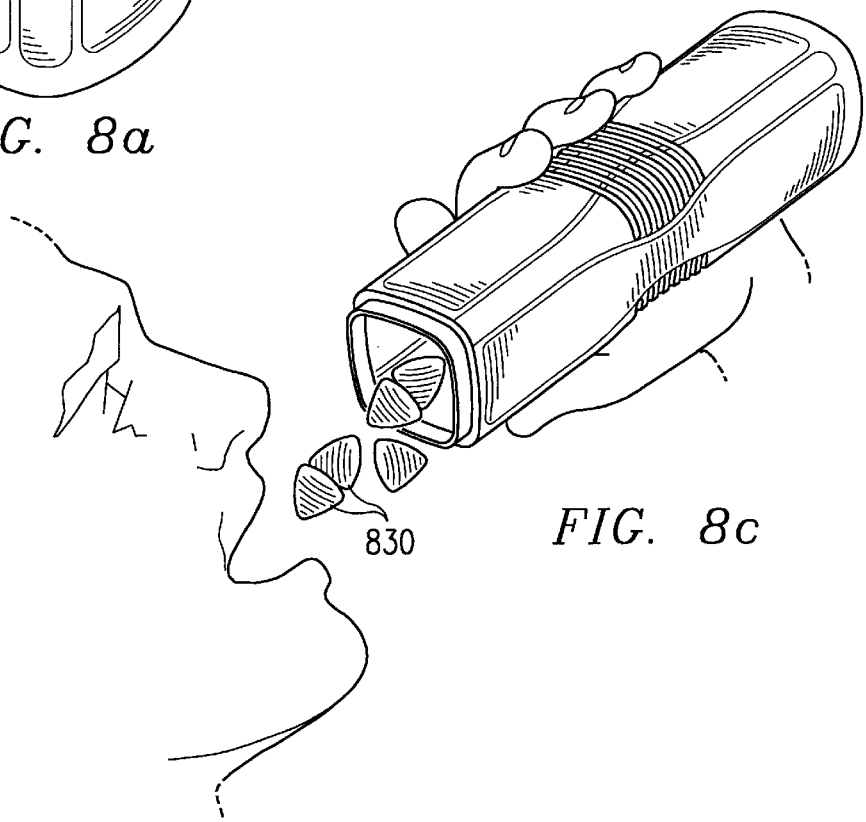

FIGS. 8*a*, 8*b*, and 8*c* illustrate another variation on a square shaped container that incorporates a snap-off lid 870. This snap-off lid 870 is removed from the container by pressing upward on an integral tab 872, as illustrated in FIG. 8*b*. This exposes a seal 820, which in turn is removable by pulling back on a tab 822 component. Once both the cap 870 and seal 820 have been removed from the container, product 830 can be dispensed from the container, as illustrated in FIG. 8*c*.

Figure 9A:
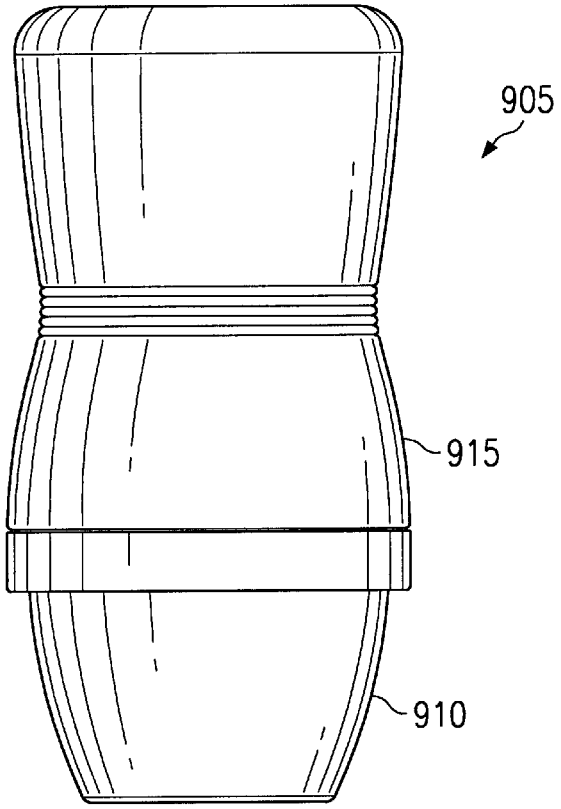
FIG. 9*a* is a side view of a multiple product embodiment of the present invention.
Figure 9B:
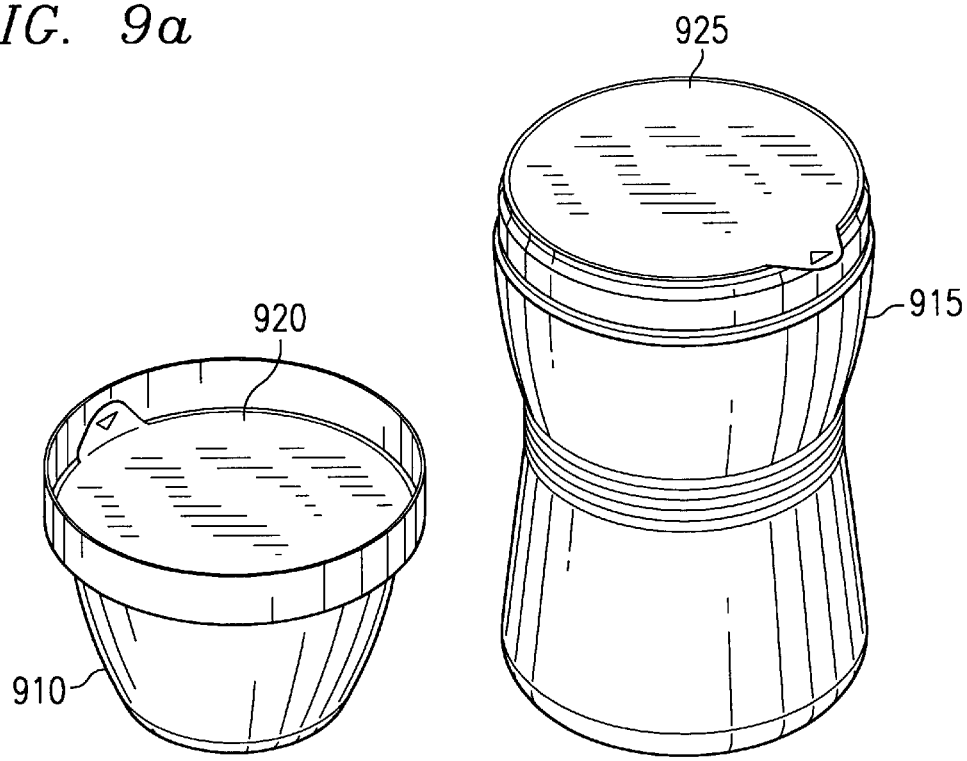
FIG. 9*b* is a perspective view of a multiple product embodiment of the present invention showing the cap removed.
Figure 9C:
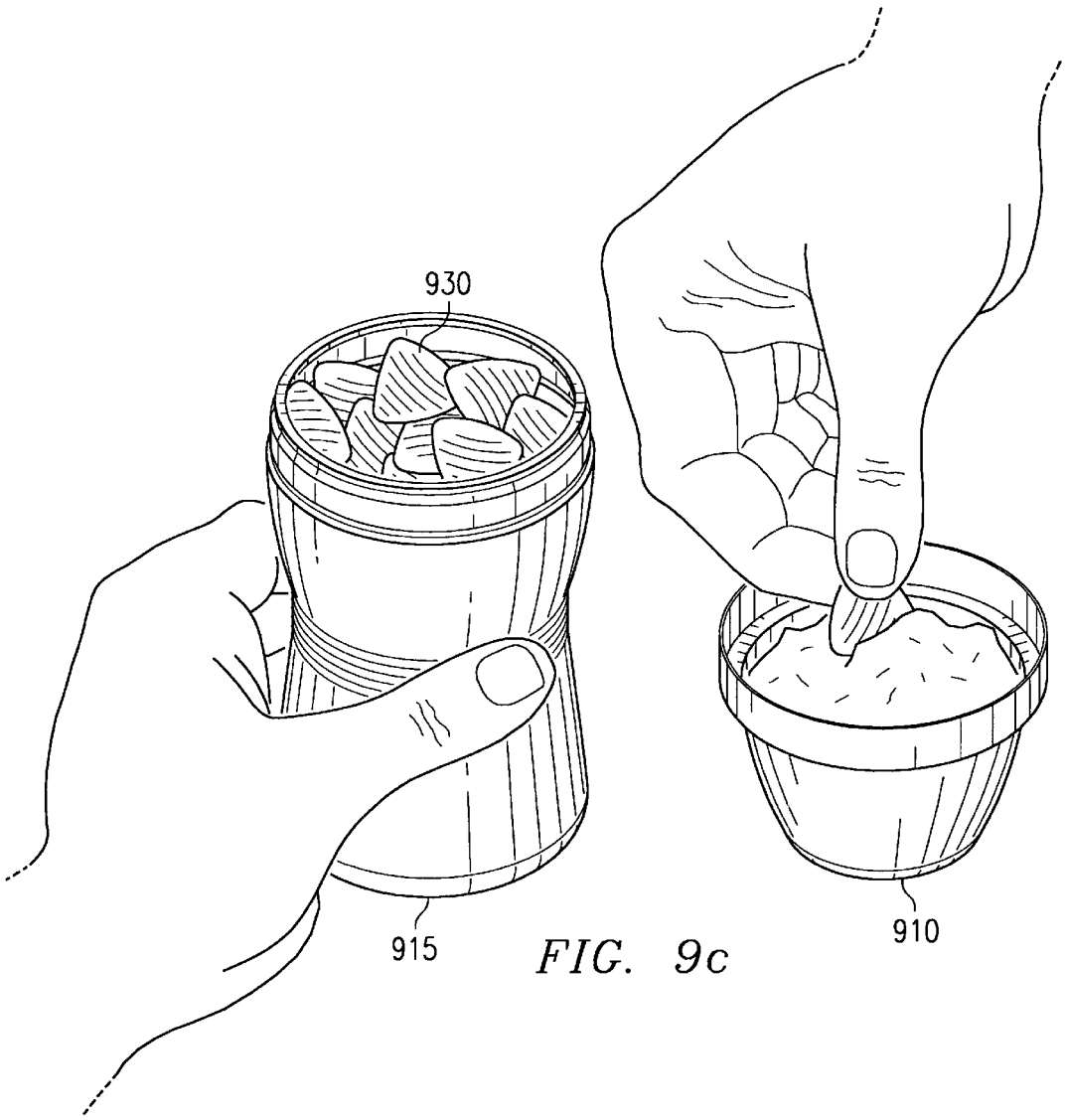
FIG. 9*c* is a perspective view of a multiple product embodiment of the present invention showing exposed chips and dip.

FIGS. 9*a*, 9*b*, and 9*c* illustrate a container for holding two types of products in separate compartments. The container 905 may be used, for example, to conveniently hold chips and dip. The dip is placed in the cap 910 and the chips are placed in the receptacle 915. A removable seal 920 is used to seal the dip into the integral cap and dip container 910. Similarly, a removable seal 925 is used to seal chips or other food product in the receptacle 915. After the chips and dip are sealed into the main body and the cap, respectively, the cap 910 is snapped onto the receptacle 915. An outer layer may be placed over the container as described above in reference to FIG. 1. The container 905 can be displayed in an inverted position as shown in FIG. 9*a* to make the display more stable since the dip in the cap 910 is heavier than the chips in the container 915, thus resulting in a lower center of gravity than would be the case if the container were placed in an upright position. FIG. 9*c* is an illustration of the product being consumed. The removable seals 920, 925 have been removed by the consumer and now the cap 910 acts as a bowl from which the dip may be consumed. The chips 930 may be consumed directly from the main body 915 or the consumer may poor some or all of the chips out of the container. The container may also be re-closed by the consumer to save the unused chips and/or dip for later consumption. The nature of the container 905 allows the packaging process to be fully automated without the need for someone to assemble or hold the cap on the container until an outer layer is placed around the product.

Figure 10A:
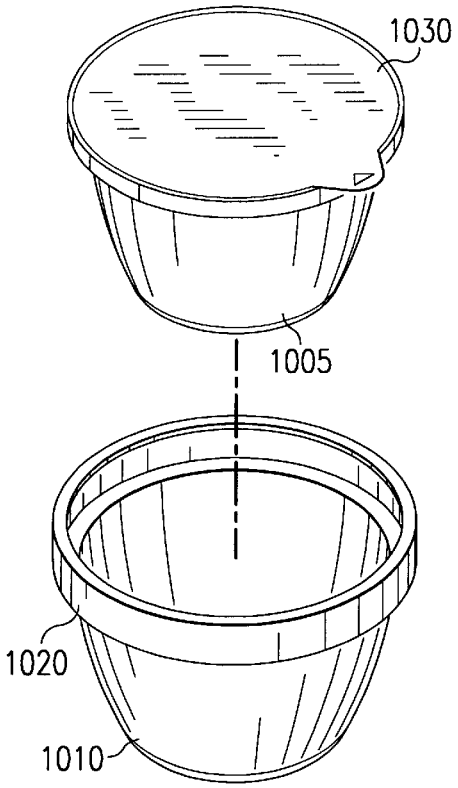
FIGS. 10*a* is a perspective view of a standard cup being inserted into a cap in accordance with a multiple product embodiment of the present invention.
Figure 10B:
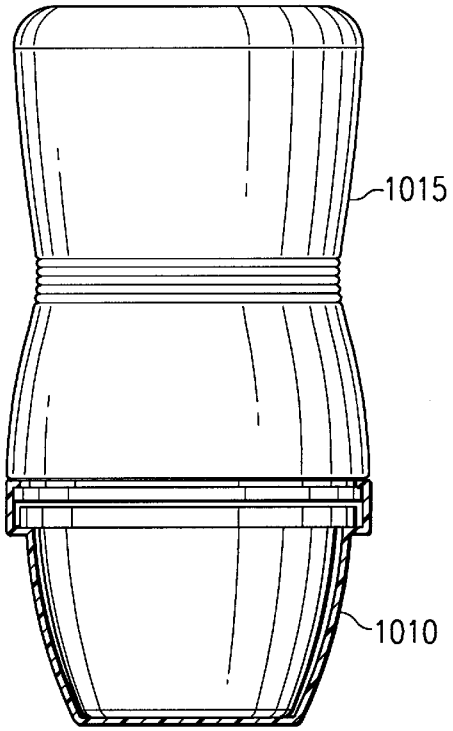
FIG. 10*b* is a side view of a multiple product embodiment of the present invention with a sectional view of the cap showing a standard cup inside the cap.
Figure 10C:
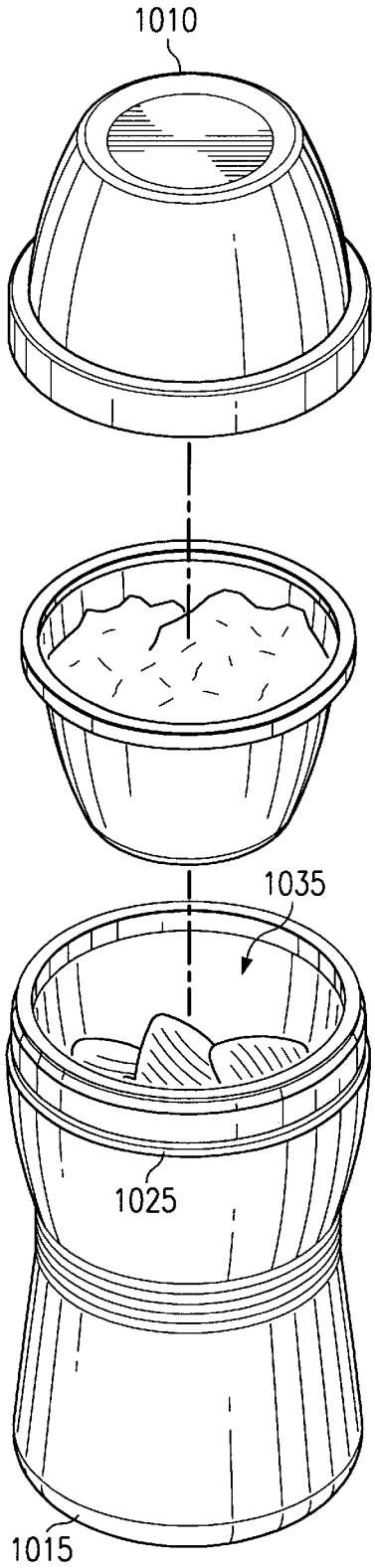
FIG. 10*c* is a perspective view of a multiple product embodiment of the present invention utilizing a standard dip cup showing the re-assembly of the container after it is opened by a user.

FIGS. 10*a*, 10*b* and 10*c* illustrate a container for holding multiple products in separate compartments in which a standard cup is used. A standard cup 1005 with a removable seal 1030 is nested in a cap 1010 and chips or another suitable food product is placed in the receptacle 1015 and a removable seal attached to the mouth of the receptacle 1015 to seal the food product. The standard cup can be any container for holding consumer portions of products such as chili cups, dip cups, cheese cups, ketchup pouches, or other condiments or products that may be contained within said cap 1010. The standard cup 1005 is typically limited in volume to the volume of the cap 1010. Although this embodiment is described in terms of a "standard cup" commonly used in the art, the invention is not limited to the use of a standard cup. Other sub-containers may be used with the invention herein. The dimensions of the cap 1010 should be such that the standard cup 1005 will fit into the cap 1010. Preferably, the standard cup 1005 is a slightly loose fit in the cap 1010 so that it nests inside the cap 1010. The standard cup 1005 can also be shaped such that it can be inserted into the receptacle 1015 in an upright position as shown in FIG. 10*c*. Thus, the receptacle can hold the standard cup in the opening 1035 while the product in the standard cup 1005 is being consumed. The receptacle 1015 may be constructed with a curved, generally cylindrical shape as shown in FIG. 10 to allow the container to be easily gripped by a consumer in one hand. The shape shown in FIG. 10 is such that the container fits both large and small hands comfortably. The receptacle can also be sized such that the receptacle 1015 will fit in a cup holder in an automobile or airplane, for instance, to allow ease of consumption while the consumer is "on the go." As an example of how the container of FIG. 10 may be utilized by a consumer, the container is opened and the seals removed from the receptacle 1015 and the standard cup 1005. The consumer can then pour some product (chips, for example) out of the receptacle 1015 into the removable cap 1010. Then the standard cup 1005 can be nested inside the opening of the receptacle 1015 and the container placed into a cup holder. The consumer then eats the chips out of the removable cap 1010 while dipping the chips into the dip contained in the standard cup 1005. In this manner, the consumer can conveniently consume the chips and dip without the need for a table on which to place the dip container.

The cap 1010 has a lip 1020 that protrudes away from the inner wall toward the center of the cap 1010. The receptacle 1015 has a groove 1025 in the mating surface of the receptacle 1015 for receiving the lip 1020 when the cap 1010 is placed on the receptacle 1015. When the container is assembled, the lip 1020 engages the groove 1025 to hold the cap 1010 securely on the receptacle 1015. The cap 1010 may be manufactured from a polypropylene that allows the lip to stretch and the main body to compress while the cap 1010 is "snapped" onto the main body 1015. However, the container of the present invention is not limited to polypropylene. Any flexible material such as a polypropylene-type plastic may be used. The lip and groove feature of this embodiment of the invention acts as a locking mechanism to prevent the container from being inadvertently opened. Because of this positive engagement, the use of an outer layer, although optional, is not necessary to hold the container together. Although this embodiment is described in terms of a lip and groove mating surface, this invention is not limited to this particular type of mating surface. Other mating surfaces may be used without departing from the scope and spirit of the invention. The cap 1010 may also be manufactured such that the standard cup 1005 may be seen through the cap 1010, thus allowing a consumer to see the standard cup 1005 without opening the container. This provides added marketing appeal to the container.

Although not limited to any particular method of manufacturing, the receptacle 1015 can be manufactured using an extrusion blow molding wheel commonly known in the art. The shape shown in FIG. 10 can be formed using a dual parrison, mouth to mouth mold. This results in a high output, low-cost container. The materials used in manufacturing the container should be such that the container has effective barrier properties for the product. A container has effective barrier properties when it maintains product integrity under normal conditions for the designed shelf-life of the product.

An outer layer may also be placed around the container for additional barrier protection and decoration as described in reference to FIG. 1. If the cap 1010 is transparent, the outer layer should also be transparent on the bottom to allow the standard cup 1005 to be seen through the cap 1010. When the product is consumed, the consumer may either eat the chips or other food product directly out of the mouth of the container 1035 or it may be poured into the cap 1010 after the standard cup 1005 is removed. Preferably the mouth of the receptacle 1015 is wide enough to allow easy consumption of the product directly from the receptacle 1015. After consuming a portion of the product, the standard cup 1005 can be placed into the main body 1015 in an upright position as shown in FIG. 10*c*. The cap 1010 is snapped back onto the container to hold the standard cup 1005 in place and allow for convenient storage of the container in a refrigeration unit such that the dip, chili, or other product in the standard cup 1005 is preserved for later consumption. This method of re-closing the container prevents the two products from undesirably mixing together.

The embodiment shown in FIG. 10 for a food product combination "kit" is more portable and easier to use than prior art combination containers. The container is ergonomically shaped to allow it to be easily handled for people with an "on the go" lifestyle, and yet is large enough to handle the package and access the product while it is being consumed. The shape is also more appealing and takes up much less shelf space than current combination containers. The cost of producing the container disclosed is also much lower because large trays and packaging film are eliminated.

It should be understood that all of the alternative container embodiments discussed above can incorporate a multi-functional cap with a shape to accommodate the overall container shape. For example, a multi-functional cap could be used with the square container shapes illustrated in FIGS. 7*a* and 8*a*, wherein the cap would have a similar square shape in order to nest over the mouth of the container, seat in the mouth of the container when inverted, and nest for storage over the bottom of the container. Further, the discussion of specific container shapes and cap designs is not limiting on the invention, which focuses on the goal of a simple design with maximum utility for the consumer.

While the invention has been particularly shown and described with reference to a preferred embodiment, it will be understood by those skilled in the art that various changes in form and detail may be made therein without departing from the spirit and scope of the invention.

What is claimed is:

1. A container for a plurality of consumables comprising:

a receptacle for holding a first product, said receptacle having a first end and a second end wherein said first end is shaped to hold a standard cup containing a second product such that a lip on a top end of said standard cup prevents said standard cup from falling into said receptacle when a bottom end of said standard cup is inserted into said receptacle through said first end; and a removable cap placed over said first end of said receptacle, wherein said removable cap is shaped for holding said standard cup while allowing said removable cap to be joined together with said first end of said receptacle, wherein said standard cup can be held in an inverted position within said removable cap, and wherein said standard cup can be partially inserted into said receptacle in an upright position and said removable cap placed over said first end of said receptacle to close said receptacle and said standard cup.

2. The container of claim 1 wherein said container can be re-closed by a consumer after opening by placing said bottom end of said standard cup into said first end of said receptacle and placing said removable cap over said first end of said receptacle such that said first product and said second product are kept separated.

3. The container of claim 1 wherein said first end of said receptacle comprises a seal as a barrier protection for said first product and wherein said standard cup comprises a second seal for containing said second product while said standard cup is in said inverted position.

4. The container of claim 1 wherein said first end of said receptacle comprises a locking surface for gripping said removable cap when said removable cap is placed over said first end of said receptacle.

5. The container of claim 1 further comprising an outer layer wrapped over said receptacle and said cap.

6. The container of claim 5 wherein said outer layer comprises a graphics carrier.

7. The container of claim 5 wherein said receptacle and said outer layer provide complimentary oxygen and moisture barrier properties.

8. The container of claim 1 wherein said cap is seatable on said first end of said receptacle such that said cap is usable as a bowl for holding product during consumption.

9. The container of claim 1 wherein said first end of said receptacle comprises a removable seal.

10. The container of claim 1 further comprising said standard cup for holding said second product wherein a removable seal is attached to said lip of said standard cup and wherein said standard cup is placed loosely inside said cap.

11. The container of claim 1 wherein said container comprises a generally cylindrical shape.

12. The container of claim 1 wherein said receptacle comprises a shape that provides a hand grip for a consumer using said container.

13. The container of claim 1 wherein said cap comprises a collar.

14. The container of claim 1 wherein said cap comprises a lip protruding inward from an outside edge of said cup for engaging a groove on said first end of said receptacle such that said cap and said receptacle are held together securely.

15. The container of claim 1 wherein said removable cap comprises a transparent material to allow said standard cup to be seen through said removable cap.

16. The container of claim 1 wherein said receptacle is of a size that allows said receptacle to be placed in a cup holder while holding said standard cup in said first end of said receptacle such that a consumer can access said second product without holding said standard cup.

17. A consumables container for a plurality of products comprising:

a receptacle for holding a first product, said receptacle having a first end defining an opening into said container;

a removable cap placed over said first end of said receptacle for closing said container; and a standard cup for holding a second product, wherein said standard cup can be nested in a first position within said removable cap, wherein said standard cup can be nested in a second position in said opening when said removable cap is removed, and wherein said removable cap can be placed over said first end of said receptacle to reclose said container while said standard cup is nested in said second position in said opening of said receptacle such that said first product is kept separated from said second product.

18. The container of claim 17 wherein said removable cap seats in said opening of said first end when inverted from a closed position over said opening, thus acting as a cup and sealing said first end.

19. The container of claim 17 wherein said removable cap nests over a second end of said receptacle for storage of said removable cap.

20. The container of claim 17 further comprising a thin film wrapped over said receptacle.

21. The container of claim 20 wherein said container and said thin film comprise in combination effective oxygen and moisture barriers.

22. The container of claim 21 wherein said thin film comprises a graphics carrier.

23. The container of claim 21 wherein said thin film comprises a shrink wrap over said receptacle and said cap.

24. The container of claim 17 further comprising a slight circumferential restriction located between said first end and said second end to provide for a hand grip for a consumer using said container.

25. The container of claim 17 wherein said cap further comprises a collar for facilitating stacking and increasing hoop strength.

26. The container of claim 17 wherein said opening comprises a removable seal attached over said opening for sealing said first product in said receptacle.

27. The container of claim 26 wherein said standard cup comprises a second removable seal attached over a top end of said standard cup.

28. The container of claim 17 wherein said receptacle is sized to allow said receptacle to be placed in a cup holder while said standard cup is nested in said opening of said receptacle such that a consumer can access said second product without holding said standard cup.

29. A consumables container for use in storing and consuming a plurality of products comprising:

a receptacle for holding a first product, said receptacle having a first end defining an opening into said container and a first mating surface and wherein said receptacle is shaped to provide a grip for a consumer;

a removable cap placed over said opening for closing said container, said removable cap having a second mating surface for mating with said first mating surface to form a closed container;

a sub-container nested in said removable cap for holding a second product, wherein said sub-container is nestable in said opening when said removable cap is removed and wherein said removable cap can be placed over said opening to re-close said container while said sub-container is nested in said opening of said receptacle such that said first product is kept separated from said second product;

wherein said container provides effective barrier properties for said first product and said second product when said container is in a closed configuration.

30. The container of claim 29 wherein said removable cap seats in said opening in said receptacle when inverted from a closed position over said opening, thus acting as a cup and sealing said first end.

31. The container of claim 29 wherein said removable cap nests over a second end of said receptacle for storage of said removable cup.

32. The container of claim 29 wherein said receptacle comprises a circumferential restriction of a cylindrical shape located between said first end and said second end to provide said grip.

33. The container of claim 29 wherein said container further comprises a thin film over said container for providing additional barrier properties.

34. The container of claim 33 wherein said thin film comprises a shrink wrap graphics carrier.

35. The container of claim 29 wherein said receptacle is sized to allow said receptacle to be placed in a cup holder while said sub-container is nested in said opening of said receptacle such that a consumer can access said second product without holding said sub-container.

* * * * *